US008114251B2

(12) United States Patent
Levit et al.

(10) Patent No.: US 8,114,251 B2
(45) **Date of Patent: *Feb. 14, 2012**

(54) PAPERS CONTAINING FIBRIDS DERIVED FROM DIAMINO DIPHENYL SULFONE

(75) Inventors: Mikhail R Levit, Glen Allen, VA (US); Vlodek Gabara, Richmond, VA (US); Gary Lee Hendren, Richmond, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 767 days.

This patent is subject to a terminal disclaimer.

(21) Appl. No.: 12/004,720

(22) Filed: Dec. 21, 2007

(65) Prior Publication Data

US 2009/0159227 A1 Jun. 25, 2009

(51) Int. Cl.
*D21H 13/26* (2006.01)
*D21D 1/30* (2006.01)
*B32B 5/00* (2006.01)

(52) U.S. Cl. ..... 162/146; 162/138; 162/157.1; 428/172; 428/537.5; 428/116

(58) Field of Classification Search ..... 162/141, 162/146, 157.1–157.4, 138; 428/105, 113, 428/116, 212, 221, 292.1, 299.7, 323, 327, 428/220, 73, 537.5, 172, 156; 442/327, 333, 442/414, 415

See application file for complete search history.

(56) References Cited

U.S. PATENT DOCUMENTS

| | | | | |
|---|---|---|---|---|
| 2,988,782 | A | 6/1961 | Parrish et al. | |
| 2,999,788 | A | 9/1961 | Morgan | |
| 3,018,091 | A | 1/1962 | Duggins | |
| 3,063,986 | A | 11/1962 | Kwolek et al. | |
| 3,227,793 | A | 1/1966 | Cipriani | |
| 3,287,324 | A | 11/1966 | Sweeny | |
| 3,356,760 | A * | 12/1967 | Matray | 525/133 |
| 3,414,845 | A | 12/1968 | Morgan, Jr. | |
| 3,756,908 | A | 9/1973 | Gross | |
| 3,767,756 | A | 10/1973 | Blades | |
| 3,869,429 | A | 3/1975 | Blades | |
| 3,869,430 | A | 3/1975 | Blades | |
| 4,075,172 | A * | 2/1978 | Ozawa et al. | 528/183 |
| 4,162,275 | A * | 7/1979 | Moulds | 525/428 |
| 4,169,932 | A | 10/1979 | Sokolov et al. | |
| 4,202,962 | A | 5/1980 | Bach | |
| 4,654,100 | A * | 3/1987 | Yats et al. | 156/246 |
| 4,851,021 | A * | 7/1989 | Bohrn et al. | 65/17.1 |
| 4,990,405 | A * | 2/1991 | Bohrn et al. | 428/413 |
| 5,026,456 | A | 6/1991 | Hesler et al. | |
| 5,089,088 | A * | 2/1992 | Hendren et al. | 162/123 |
| 5,126,012 | A * | 6/1992 | Hendren et al. | 162/146 |
| 5,223,094 | A * | 6/1993 | Kirayoglu et al. | 162/145 |
| 5,371,153 | A * | 12/1994 | Kuribayashi et al. | 525/423 |
| 5,393,601 | A * | 2/1995 | Heinrich et al. | 442/411 |
| 5,431,782 | A * | 7/1995 | Cassat | 162/145 |
| 5,482,773 | A | 1/1996 | Bair | |
| 5,578,368 | A * | 11/1996 | Forsten et al. | 442/407 |
| 5,621,067 | A * | 4/1997 | Lin et al. | 528/310 |
| 5,667,743 | A | 9/1997 | Tai et al. | |
| 5,910,231 | A * | 6/1999 | Kirayoglu et al. | 162/145 |
| 7,459,044 | B2 * | 12/2008 | Khan et al. | 156/62.2 |
| 7,803,247 | B2 * | 9/2010 | Levit et al. | 162/146 |
| 2002/0142689 | A1 * | 10/2002 | Levit | 442/381 |
| 2003/0082974 | A1 * | 5/2003 | Samuels et al. | 442/327 |
| 2003/0087077 | A1 * | 5/2003 | Samuels et al. | 428/292.1 |
| 2003/0162457 | A1 * | 8/2003 | Berrigan et al. | 442/327 |
| 2004/0089432 | A1 * | 5/2004 | Levit | 162/157.3 |
| 2004/0132372 | A1 * | 7/2004 | Samuels et al. | 442/327 |
| 2005/0136233 | A1 * | 6/2005 | Samuels et al. | 428/212 |
| 2005/0230072 | A1 * | 10/2005 | Levit | 162/146 |
| 2006/0266486 | A1 * | 11/2006 | Levit | 162/146 |
| 2007/0137818 | A1 * | 6/2007 | Levit et al. | 162/146 |
| 2007/0144695 | A1 * | 6/2007 | Amma et al. | 162/146 |
| 2008/0057807 | A1 * | 3/2008 | Tutterow et al. | 442/1 |
| 2008/0145596 | A1 * | 6/2008 | Levit et al. | 428/116 |
| 2008/0242827 | A1 * | 10/2008 | Wang et al. | 528/172 |
| 2009/0126887 | A1 * | 5/2009 | Levit | 162/157.4 |
| 2009/0159226 | A1 * | 6/2009 | Levit et al. | 162/146 |
| 2009/0159227 | A1 * | 6/2009 | Levit et al. | 162/146 |
| 2009/0162605 | A1 * | 6/2009 | Levit et al. | 428/116 |
| 2009/0250181 | A1 * | 10/2009 | Levit | 162/146 |
| 2010/0212851 | A1 * | 8/2010 | Levit et al. | 162/157.3 |

FOREIGN PATENT DOCUMENTS

| | | | |
|---|---|---|---|
| CN | 1389604 | A | 1/2003 |
| CN | 1631941 | A | 6/2005 |
| CN | 1631941 | A | 6/2005 |
| EP | 426191 | A1 * | 5/1991 |
| EP | 446870 | A1 * | 9/1991 |
| EP | 1975285 | A2 * | 10/2008 |
| JP | 05033289 | A * | 2/1993 |
| JP | 06047759 | A * | 2/1994 |
| JP | 06 191154 | | 7/1994 |
| JP | 2007 216512 | | 8/2007 |
| WO | WO 02059411 | A2 * | 8/2002 |
| WO | WO 2007075575 | A2 * | 7/2007 |
| WO | WO 2007076334 | A2 * | 7/2007 |
| WO | WO 2007076343 | A2 * | 7/2007 |
| WO | WO 2008027454 | A1 * | 3/2008 |

OTHER PUBLICATIONS

Machine Translation of Chinese Publication No. 1389604, Published on Jan. 8, 2003.*

Machine Translation of Chinese Publication No. 1631941, Published on Jun. 29, 2005.*

G. A. Smook, "Handbook of Pulp & Paper Terminology" 1990, Angus Wilde Publications Inc., Chapter 3, p. 33.*

DuPont™ ReliatralN® Russia, NOMEX® a family of insulation, no dated, pp. 1-3.*

* cited by examiner

*Primary Examiner* — Jose A Fortuna

(57) ABSTRACT

This invention relates to papers made with fibrids containing a polymer or copolymer derived from a monomer selected from the group consisting of 4,4'diaminodiphenyl sulfone, 3,3'diaminodiphenyl sulfone, and mixtures thereof. Such papers have high thermal stability and accept ink more readily than papers made solely with aramid fibrids.

13 Claims, No Drawings

PAPERS CONTAINING FIBRIDS DERIVED FROM DIAMINO DIPHENYL SULFONE

BACKGROUND OF THE INVENTION

1. Field of the Invention

This invention relates to papers made with fibrids containing a polymer or copolymer derived from a monomer selected from the group consisting of 4,4'diaminodiphenyl sulfone, 3,3'diaminodiphenyl sulfone, and mixtures thereof. Such papers have high thermal stability and accept ink more readily than papers made solely with aramid fibrids.

2. Description of Related Art

Papers made from high performance materials have been developed to provide papers with improved strength and/or thermal stability. Aramid paper, for example, is synthetic paper composed of aromatic polyamides. Because of its heat and flame resistance, electrical insulating properties, toughness and flexibility, the paper has been used as electrical insulation material and a base for aircraft honeycombs. Of these materials, Nomex® of DuPont (U.S.A.) is manufactured by mixing poly(metaphenylene isophthalamide) floc and fibrids in water and then subjecting the mixed slurry to papermaking process to make formed paper followed by hot calendering of the formed paper. This paper is known to have excellent electrical insulation properties and with strength and toughness, which remains high even at high temperatures.

Generally such aramid papers are difficult to color and print; for some applications aramid papers are coated to provide a better surface for printing of bar codes and other indicia. This requires an additional step after paper manufacture and the resulting waste that is generated by an additional manufacturing step. Therefore, there is an ongoing need for high performance papers with improved properties, particularly papers that will accept ink or color more readily than high performance papers such as known aramid papers.

BRIEF SUMMARY OF THE INVENTION

This invention relates to a highly printable thermally stable paper comprising non-granular, fibrous or film-like polymer fibrids comprising a polymer or copolymer derived from an anine monomer selected from the group consisting of 4,4'diaminodiphenyl sulfone, 3,3'diaminodiphenyl sulfone, and mixtures thereof, the fibrids having an average maximum dimension of 0.1 to 1 mm, a ratio of maximum to minimum dimension of 5:1 to 10:1, and a thickness of no more than 2 microns; and high performance floc selected from the group of para-aramid, meta-aramid, carbon, glass, liquid crystalline polyester, polyphenylene sulfide, polyether-ketone-ketone, polyether-ether-ketone, polyoxadiazole, polybenzazole, and mixtures thereof, the floc having a length of from 2 to 25 mm; and at least one floc selected from the group of polyester, aliphatic polyamide, viscose and mixtures thereof. In various embodiments, this invention also relates to heat resistant tags and labels, wrapped wires and conductors, laminate structures, honeycomb structures, and electrical devices comprising this highly printable thermally stable paper. (As employed herein "film-like" means "film".)

This invention also relates to a process for making thermally stable paper comprising the steps of:

a) forming an aqueous dispersion of 10 to 95 parts by weight polymer fibrids comprising a polymer or copolymer derived from an amine monomer selected from the group consisting of 4,4'diaminodiphenyl sulfone, 3,3'diaminodiphenyl sulfone, and mixtures thereof, and 90 to 5 parts by weight floc based on the total weight of the floc and fibrids, wherein the floc is a mixture of i) at least one high performance floc selected from the group of para-aramid, meta-aramid, carbon, glass, liquid crystalline polyester, polyphenylene sulfide, polyether-ketone-ketone, polyether-ether-ketone, polyoxadiazole polybenzazole, and mixtures thereof, and ii) at least one floc selected from the group of polyester, aliphatic polyamide, viscose and mixtures thereof;

b) blending the dispersion to form a slurry, c) draining the aqueous liquid from the slurry to yield a wet paper composition, and d) drying the wet paper composition to make a formed paper.

If desired, the process includes the additional step of consolidating the formed paper under heat and pressure to make a calendered paper.

DETAILED DESCRIPTION OF THE INVENTION

This invention relates to the use of polymer fibrids containing a polymer or copolymer derived from a monomer selected from the group consisting of 4,4'diaminodiphenyl sulfone, 3,3'diaminodiphenyl sulfone, and mixtures thereof in papers for improved printability without sacrificing thermal stability of the paper. Such polymers have [$SO_2$] linkages that help promote printability of the paper.

The term "fibrids" as used herein, means a very finely-divided polymer product of small, filmy or irregular fibrous shape particles. There are essentially two types of fibrids; "filmy" fibrids and "fibrous shape" or "stringy" fibrids. Filmy fibrids are essentially two-dimensional particles having a length and width on the order of 100 to 1000 micrometers and a thickness of 0.1 to 1 micrometer. Fibrous shape or stringy fibrids usually have length of up to 2-3 mm, a width of 10 to 50 microns, and a thickness of 0.1 to 1 micrometer. Fibrids are made by streaming a polymer solution into a coagulating bath of liquid that is immiscible with the solvent of the solution. The stream of polymer solution is subjected to strenuous shearing forces and turbulence as the polymer is coagulated. The predominant shape of the fibrids is determined by the type of polymer and the particular processing conditions during their coagulation.

Preferably, fibrids have a melting point or decomposition point above 320° C. Fibrids are not fibers, but they are fibrous in that they have fiber-like regions connected by webs. In on embodiment, fibrids have an aspect ratio of 5:1 to 10:1. In another embodiment, fibrids are used wet in a never-dried state and can be deposited as a binder physically entwined about other ingredients or components of a paper. The fibrids can be prepared by any method including using a fibridating apparatus of the type disclosed in U.S. Pat. No. 3,018,091 where a polymer solution is precipitated and sheared in a single step. Fibrids can also be made via the processes disclosed in U.S. Pat. Nos. 2,988,782 and 2,999,788.

The fibrids comprise a polymer or copolymer derived from an amine monomer selected from the group consisting of 4,4'diaminodiphenyl sulfone, 3,3'diaminodiphenyl sulfone, and mixtures thereof. Such polymers and copolymers generally having the structure:

NH2-Ar1-SO2-Ar2-NH2 wherein Ar1 and Ar2 are any unsubstituted or substituted six-membered aromatic group of carbon atoms and Ar1 and Ar2 can be the same or different. In some preferred embodiments Ar1 and Ar2 are the same. Still more preferably, the six-membered aromatic group of carbon atoms has meta- or para-oriented linkages versus the $SO_2$ group. This monomer or multiple monomers having this general structure are reacted with an acid monomer in a compatible solvent to create a polymer. Useful acids monomers generally have the structure of Cl—CO—Ar3-CO—Cl wherein Ar3 is any unsubstituted or substituted aromatic ring structure and can be the same or different from Ar1 and/or Ar2. In some preferred embodiments Ar3 is a six-membered aromatic group of carbon atoms. Still more preferably, the six-membered aromatic group of carbon atoms has meta- or para-oriented linkages. In some preferred embodiments Ar1 and Ar2 are the same and Ar3 is different from both Ar1 and Ar2. For example, Ar1 and Ar2 can be both benzene rings having meta-oriented linkages while Ar3 can be a benzene ring having para-oriented linkages. Examples of useful monomers include terephthaloyl chloride, isophthaloyl chloride, and the like. In some preferred embodiments, the acid is terephthaloyl chloride or its mixture with isophthaloyl chloride and the amine monomer is 4,4'diaminodiphenyl sulfone. In some other preferred embodiments, the amine monomer is a mixture of 4,4'diaminodiphenyl sulfone and 3,3'diaminodiphenyl sulfone in a weight ratio of 3:1, which creates a fibrid made from a copolymer having both sulfone monomers.

In still another preferred embodiment, the fibrids contain a copolymer, the copolymer having both repeat units derived from sulfone amine monomer and an amine monomer derived from paraphenylene diamine and/or metaphenylene diamine. In some preferred embodiments the sulfone amide repeat units are present in a weight ratio of 3:1 to other amide repeat units. In some embodiments, at least 80 mole percent of the amine monomers is a sulfone amine monomer or a mixture of sulfone amine monomers. For convenience, herein the abbreviation "PSA" will be used to represent all of the entire classes of fibers made with polymer or copolymer derived from sulfone monomers as previously described.

In one embodiment, the polymer and copolymer derived from a sulfone monomer can preferably be made via polycondensation of one or more types of diamine monomer with one or more types of chloride monomers in a dialkyl amide solvent such as N-methylpyrrolidone, dimethyl acetamide, or mixtures thereof. In some embodiments of the polymerizations of this type an inorganic salt such as lithium chloride or calcium chloride is also present. If desired the polymer can be isolated by precipitation with non-solvent such as water, neutralized, washed, and dried. The polymer can also be made via interfacial polymerization which produces polymer powder directly that can then be dissolved in a solvent for fiber production.

Specific methods of making PSA fibers or copolymers containing sulfone amine monomers are disclosed in Chinese Patent Publication 1389604A to Wang et al. This reference discloses a fiber known as polysulfonamide fiber (PSA) made by spinning a copolymer solution formed from a mixture of 50 to 95 weight percent 4,4'diaminodiphenyl sulfone and 5 to 50 weight percent 3,3'diaminodiphenyl sulfone copolymerized with equimolar amounts of terephthaloyl chloride in di-methylacetamide. Chinese Patent Publication 1631941A to Chen et al also discloses a method of preparing a PSA copolymer spinning solution formed from a mixture of 4,4'diaminodiphenyl sulfone and 3,3'diaminodiphenyl sulfone in a mass ratio of from 10:90 to 90:10 copolymerized with equimolar amounts of terephthaloyl chloride in dimethylacetamide. Still another method of producing copolymers is disclosed in U.S. Pat. No. 4,169,932 to Sokolov et al. This reference discloses preparation of poly(paraphenylene) terephthalamide (PPD-T) copolymers using tertiary amines to increase the rate of polycondensation. This patent also discloses the PPD-T copolymer can be made by replacing 5 to 50 mole percent of the paraphenylene diamine (PPD) by another aromatic diamine such as 4,4'diaminodiphenyl sulfone.

In one embodiment, a portion of the PSA fibrids can be replaced by another, second, non-granular, fibrous or film-like polymer binder. Such binders include fibrids made from another polymer or copolymer. In a preferred embodiment the polymer binder is selected from the group of meta-aramid fibrids, para-aramid fibrids, and mixtures thereof. The preferred meta-aramid fibrids are poly(metaphenylene isophthalamide) fibrids.

In one embodiment, it is believed that up to about 80 weight percent of the PSA fibrids can be replaced with MPD-I fibrids with good result. However, in a preferred embodiment, 20 to 50 weight percent of the PSA fibrids are replaced with MPD-I fibrids. It is believed the improved dyeability and printability of the paper due to the additional polysulfone groups provided by the PSA fibrids is retained even with only 20 weight percent PSA fibrids in the paper.

If desired, the fibrids in the paper can be filled with different fillers including carbon black, graphite, and mineral powders. In a preferred embodiment the filled fibrids are PSA fibrids. Method of filling fibrids with carbon black or graphite is described, for example, in U.S. Pat. No. 5,482,773 to Bair.

The PSA fibrids are combined with at least two different flocs. A first floc is at least one high performance floc selected from the group of para-aramid, meta-aramid, carbon, glass, liquid crystalline polyester, polyphenylene sulfide, polyether-ketone-ketone, polyether-ether-ketone, polyoxadiazole, polybenzazole, and mixtures thereof. A second floc is at least one floc selected from the group of polyester, aliphatic polyamide, viscose and mixtures thereof.

By "floc", is meant fibers having a length of 2 to 25 millimeters, preferably 3 to 7 millimeters and a diameter of 3 to 20 micrometers, preferably 5 to 14 micrometers. If the floc length is less than 3 millimeters, the paper strength is severely reduced, and if the floc length is more than 25 millimeters, it is difficult to form a uniform paper web by a typical wet-laid method. If the floc diameter is less than 5 micrometers, it can be difficult to commercially produce with adequate uniformity and reproducibility, and if the floc diameter is more than 20 micrometers, it is difficult to form uniform paper of light to medium basis weights. Floe is generally made by cutting continuous spun filaments into specific-length pieces.

The first high performance floc includes flocs of para-aramid, meta-aramid, carbon, glass, liquid crystalline polyester, polyphenylene sulfide, polyether-ketone-ketone, polyether-ether-ketone, polyoxadiazole polybenzazole, and mixtures thereof.

By aramid is meant a polyamide wherein at least 85% of the amide (—CONH—) linkages are attached directly to two aromatic rings. A para-aramid is such a polyamide that contains a para configuration or para-oriented linkages in the polymer chain, while meta-aramid is such a polyamide that contains a meta configuration or meta-oriented linkages in the polymer chain. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. In some embodiments, the preferred para-aramid is poly(paraphenylene terephthalamide). Methods for making para-aramid fibers useful are generally disclosed in, for example, U.S. Pat. Nos. 3,869,430; 3,869,429; and 3,767,756. Various forms of such aromatic polyamide organic fibers are sold under the trademarks of Kevlar® and Twaron® by respectively, E. I. du Pont de Nemours and Company, of Wilmington, Del.; and Teijin, Ltd, of Japan. Also, fibers based on copoly(p-phenylene/3,4'-diphenyl ether terephthalamide) are defined as para-aramid fibers as used herein. One commercially available version of these fibers is known as Technora® fiber also available from Teijin, Ltd.

In some embodiments, the preferred meta-aramids are poly (meta-phenylene isophthalamide)(MPD-I) and its copolymers. One such meta-aramid floc is Nomex® aramid fiber available from E. I. du Pont de Nemours and Company of Wilmington, Del., however, meta-aramid fibers are available in various styles under the trademarks Conex®, available from Teijin Ltd. of Tokyo, Japan; Apyeil®, available from Unitika, Ltd. of Osaka, Japan; New Star® Meta-aramid, available from Yantai Spandex Co. Ltd, of Shandong Province, China; and Chinfunex® Aramid 1313 available from Guangdong Charming Chemical Co. Ltd., of Xinhui in Guangdong, China. Meta-aramid fibers are inherently flame resistant and can be spun by dry or wet spinning using any number of processes; however, U.S. Pat. Nos. 3,063,966; 3,227,793; 3,287,324; 3,414,645; and 5,667,743 are illustrative of useful methods for making aramid fibers that could be used.

Additives can be used with the aramid and, in fact it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Commercially available carbon fibers include Tenax® fibers available from Toho Tenax America, Inc, and commercially available glass fibers include borosilicate glass microfiber type 253 sold by Johns Manville Co. Useful commercially available liquid crystal polyester fibers include Vectran® HS fiber available from Swicofil AG Textile Services. Polyphenylene sulfide fiber has good heat resistance, chemical resistance, and hydrolysis resistance. At least 90% of the constituent units of these fibers are of a polymer or copolymer having phenylene sulfide structural units of —(C6H4-S)—. Polyphenylene sulfide fiber is sold under the tradenames Ryton® by American Fibers and Fabrics, Toray PPS® by Toray Industries Inc., Fortron® by Kureha Chemical Industry Co. and Procon® by Toyobo Co. Polyether-ketone-ketone and polyether-ether-ketone fibers include Zyex® PEEK and Zyex® PEK fibers available from Zyex Ltd. (UK). Polyoxadiazole fibers also have good heat resistance and are disclosed in, for example, U.S. Pat. No. 4,202,962 to Bach and the Encyclopedia of Polymer Science and Engineering, Vol 12, p. 322-339 (John Wiley & Sons, New York, 1988). In some embodiments the polyoxadiazole fiber contains polyarylene-1,3,4-oxadiazole polymer, polyarylene-1,2,4-oxadiazole polymer, or mixtures thereof. In some preferred embodiments, the polyoxadiazole fiber contains polyparaphenylene-1,3,4-oxadiazole polymer. Suitable polyoxadiazole fibers are known commercially under various tradenames such as Oxalon®, Arselon®, Arselon-C® and Arselon-S® fiber. Useful commercially available polybenzazole fibers include Zylon® PBO-AS (Poly(p-phenylene-2,6-benzobisoxazole) fiber, Zylon® PBO-HM (Poly(p-phenylene-2,6-benzobisoxazole)) fiber, available from Toyobo, Japan.

In some preferred embodiments the high performance floc has a high modulus. As used herein high modulus fibers are those having a tensile or Young's modulus of 600 grams per denier (550 grams per dtex) or greater. High modulus of the floc provides stiffness and also can provide improved dimensional stability to the paper that can translate to the final applications of the paper. In a preferred embodiment, the Young's modulus of the fiber is 900 grams per denier (820 grams per dtex) or greater. In the preferred embodiment, the fiber tenacity is at least 21 grams per denier (19 grains per dtex) and its elongation is at least 2% so as to provide a high level of mechanical properties to the final application of the paper.

In a preferred embodiment the high modulus floc is heat resistant fiber. By "heat resistant fiber" it is meant that the fiber preferably retains 90 percent of its fiber weight when heated in air to 500° C. at a rate of 20 degrees Celsius per minute. Such fiber is normally flame resistant, meaning the fiber or a fabric made from the fiber has a Limiting Oxygen Index (LOI) such that the fiber or fabric will not support a flame in air, the preferred LOI range being about 26 and higher. The preferred heat resistant fiber is para-aramid fiber, particularly poly(paraphenylene terephthalamide) fiber.

The second floc includes flocs of polyester, aliphatic polyamide, viscose and mixtures thereof.

In some embodiments, the preferred polyesters are polyethylene terephthalate (PET) and polyethylene naphthalate (PEN) polymers. These polymers may include a variety of comonomers, including diethylene glycol, cyclohexanedimethanol, poly(ethylene glycol), glutaric acid, azelaic acid, sebacic acid, isophthalic acid, and the like. In addition to these comonomers, branching agents like trimesic acid, pyromellitic acid, trimethylolpropane and trimethyloloethane, and pentaerythritol may be used. The PET may be obtained by known polymerization techniques from either terephthalic acid or its lower alkyl esters (e.g. dimethyl terephthalate) and ethylene glycol or blends or mixtures of these. PEN may be obtained by known polymerization techniques from 2,6-naphthalene dicarboxylic acid and ethylene glycol.

The aliphatic polyamide binder useful in this invention includes any type of fiber containing nylon polymer or copolymer. Nylons are long chain synthetic polyamides having recurring amide groups (—NH—CO—) as an integral part of the polymer chain, and two common examples of nylons are nylon 66, which is polyhexamethylenediamine adipamide, and nylon 6, which polycaprolactam. Other nylons can include nylon 11, which is made from 11-aminoundecanoic acid; and nylon 610, which is made from the condensation product of hexamethylenediamine and sebacic acid. In some preferred embodiments the aliphatic polyamide is nylon 610, nylon 6, nylon 66 or mixtures thereof. Viscose fibers are also known as rayon fibers and are widely available commercially; one such fiber is Fibro® fiber available from Courtaulds.

In one embodiment, the fibrids are combined with three different flocs. In this embodiment, at least one of a third floc is used that contains a polymer or copolymer derived from a monomer selected from the group consisting of 4,4'diaminodiphenyl sulfone, 3,3'diaminodiphenyl sulfone, and mixtures thereof.

The fibrids and the floc are combined to form a thermally stable paper. As employed herein the term paper is employed in its normal meaning and it can be prepared using conventional paper-making processes and equipment and processes. The fibrous material, i.e. fibrids and floc can be slurried together to from a mix which converted to paper such as on a Fourdrinier machine or by hand on a handsheet old containing a forming screen. Reference may be made to Gross U.S. Pat. No. 3,756,908 and Hesler et al. U.S. Pat. No. 5,026,456 for processes of forming fibers into papers. If desired, once paper is formed it is calendered between two heated calendering rolls with the high temperature and pressure from the rolls increasing the bond strength of the paper. Calendering also provides the paper with a smooth surface for printing. Several plies with the same or different compositions can be combined together into the final paper structure during forming and/or calendering. In one embodiment, the paper has a weight ratio of fibrids to floc in the paper composition of from 95:5 to 10:90. In one preferred embodiment, the paper has a weight ratio of fibrids to floc in the paper composition of from 60:40 to 10:90.

In one embodiment, the formed paper has a density of about 0.1 to 0.5 grams per cubic centimeter. In some embodiments the thickness of the formed paper ranges from about 0.002 to 0.015 inches. The thickness of the calendered paper is dependent upon the end use or desired properties and in some embodiments is typically from 0.001 to 0.005 mils (25 to 130 micrometers) thick. In some embodiments, the basis weight of the paper is from 0.5 to 6 ounces per square yard (15 to 200 grams per square meter).

Additional ingredients such as fillers for the adjustment of paper conductivity and other properties, pigments, antioxidants, etc in powder or fibrous form can be added to the paper composition of this invention. If desired, an inhibitor can be added to the paper to provide resistance to oxidative degradation at elevated temperatures. Preferred inhibitors are oxides, hydroxides and nitrates of bismuth. An especially effective inhibitor is a hydroxide and nitrate of bismuth. One desired method of incorporating such fillers into the papers is by first incorporating the fillers into the fibrids during fibrid formation. Other methods of incorporating additional ingredients into the paper include adding such components to the slurry during paper forming, spraying the surface of the formed paper with the ingredients and other conventional techniques.

When PSA fibrids are incorporated as binders in papers, the sulfone groups in the PSA fibrids provide improved sites for accepting printing ink on the surface of the papers over papers having, for example, only MPD-I fibrids as binders.

In one embodiment the thermally stable paper can be made using a process comprising the steps of:

a) forming an aqueous dispersion of 10 to 95 parts by weight polymer fibrids comprising a polymer or copolymer derived from an amine monomer selected from the group consisting of 4,4'diaminodiphenyl sulfone, 3,3'diaminodiphenyl sulfone, and mixtures thereof and 5 to 90 parts by weight floc, based on the total weight of the floc and fibrids;

wherein the floc is a mixture of i) at least one high performance floc selected from the group of para-aramid, meta-aramid, carbon, glass, liquid crystalline polyester, polyphenylene sulfide, polyether-ketone-ketone, polyether-ether-ketone, polyoxadiazole polybenzazole, and mixtures thereof, and ii) at least one floc selected from the group of polyester, aliphatic polyamide, viscose and mixtures thereof;

b) blending the dispersion to form a slurry, c) draining the aqueous liquid from the slurry to yield a wet paper composition, and d) drying the wet paper composition to make a formed paper.

In another embodiment, the floc mixture further comprises at least one floc containing a polymer or copolymer derived from a monomer selected from the group consisting of 4,4'diaminodiphenyl sulfone, 3,3'diaminodiphenyl sulfone, and mixtures thereof.

The paper can be formed on equipment of any scale from laboratory screens to commercial-sized papermaking machinery, such as a Fourdrinier or inclined wire machines. The general process involves making a dispersion of the fibrids and floc, and optionally additional ingredients such as fillers, in an aqueous liquid, draining the liquid from the dispersion to yield a wet composition and drying the wet paper composition.

The dispersion can be made either by dispersing the floc in the aqueous liquid and then adding the fibrids or by dispersing the fibrids in the liquid and then adding the fibers. The dispersion can also be made by combining a floc-containing dispersion with a fiber-containing dispersion. The concentration of floc in the dispersion can range from 0.01 to 1.0 weight percent based on the total weight of the dispersion. The concentration of a fibrids in the dispersion can be up to 20 weight percent based on the total weight of solids.

In some embodiments, a portion of the PSA fibrids the aqueous dispersion can be replaced by another, second, non-granular, fibrous or film-like polymer binder. Such binders include fibrids made from another polymer or copolymer. In a preferred embodiment the polymer binder is selected from the group of meta-aramid fibrids, para-aramid fibrids, and mixtures thereof. The preferred meta-aramid fibrids are poly (metaphenylene isophthalamide) fibrids.

In one preferred embodiment, dye or pigment is included in the aqueous dispersion to make a colored paper. Any dye or pigment compatible with the final application of the paper and that is adequately bound to the sulfone groups in the paper can be used. In one preferred embodiment, the dye or pigment is added in an amount that results in the desired coloration in the final paper. The preferred dyes and pigments can withstand the calendering process, that is, temperatures of 250 degrees Celsius or greater; in some especially preferred embodiments the dyes and pigments can withstand temperatures of 310 degrees Celsius or greater.

The aqueous liquid of the dispersion is generally water, but may include various other materials such as pH-adjusting materials, forming aids, surfactants, defoamers and the like. The aqueous liquid is usually drained from the dispersion by conducting the dispersion onto a screen or other perforated support, retaining the dispersed solids and then passing the liquid to yield a wet paper composition. The wet composition, once formed on the support, is usually further dewatered by vacuum or other pressure forces and further dried by evaporating the remaining liquid.

A next step, which can be performed if higher density and strength are desired, is calendering one or more layers of the paper in the nip of metal-metal, metal-composite, or composite-composite rolls. Alternatively, one or more layers of the paper can be compressed in a platen press at a pressure, temperature and time, which are optimal for a particular composition and final application. Also, heat-treatment as an independent step before, after or instead of calendering or compressing, can be conducted if strengthening or some other property modification is desired without or in addition to densification.

The paper is useful as printable material for high temperature tags, labels, and security papers. The paper can also be used as a component in materials such as printed wining boards; or where dielectric properties are useful, such as electrical insulating material for use in motors, transformers and other power equipment. In these applications, the paper can be used by itself or in laminate structures either with or without impregnating resins, as desired. In another embodiment, the paper is used as an electrical insulative wrapping for wires and conductors. The wire or conductor can be totally wrapped, such a spiral overlapping wrapping of the wire or conductor, or can wrap only a part or one or more sides of the conductor as in the case of square conductors. The amount of wrapping is dictated by the application and if desired multiple layers of the paper can be used in the wrapping. In another embodiment, the paper can also be used as a component in structural materials such as core structures or honeycombs. For example, one or more layers of the paper may be used as the primarily material for forming the cells of a honeycomb structure. Alternatively, one or more layers of the paper may be used in the sheets for covering or facing the honeycomb cells or other core materials. Preferably, these papers and/or structures are impregnated with a resin such as a phenolic, epoxy, polyimide or other resin. However, in some instances the paper may be useful without any resin impregnation.

Test Methods

Thickness and Basis Weight (Grammage) were determined for papers of this invention in accordance with ASTM D 374 and ASTM D 646 correspondingly. At thickness measurements, method E with pressure on specimen of about 172 kPa was used.

Density (Apparent Density) of papers was determined in accordance with ASTM D 202.

Tensile Strength and Elongation were determined for papers of this invention on an Instron-type testing machine using test specimens 2.54 cm wide and a gage length of 18 cm in accordance with ASTM D 828.

Example 1

Fibrids from a copolymer of 4,4'diaminodiphenyl sulfone and 3,3'diaminodiphenyl sulfone are prepared as follows A 10% solution of a copolymer of 4,4'diaminodiphenyl sulfone and 3,3'diaminodiphenyl sulfone in DMAC is precipitated in a water bath at high shear stress using a Waring blender. The precipitate is then washed with water and is dispersed in the same blender with water for 10 minutes to form fibrids. The fibrids have a freeness of about 450 ml Shopper-Riegler.

A water slurry of these fibrids containing 2.0 grams (dry weight) of the solids is placed together with 2 grams of floc, wherein 90 weight percent of the floc is poly(metaphenylene isophthalamide) floc and 10 weight percent of the floc is polyethylene terephthalate (PET), in a laboratory mixer (British pulp evaluation apparatus) with about 1600 g of water and is agitated for 3 minutes, forming a 50/50 percent by weight mixture of fibrids and floc. The poly(metaphenylene isophthalamide) floc has a linear density of 0.22 tex (2.0 denier) and length of 0.64 cm. The PET has the same cut length.

The dispersion is then poured, with 8 liters of water, into an approximately 21×21 cm handsheet mold and a wet-laid sheet is formed. The sheet is placed between two pieces of blotting paper, is hand couched with a rolling pin and is dried in a handsheet dryer at 190° C. to make formed paper. After drying, the formed paper is calendered in the metal-metal nip at temperature of 300 C and linear pressure of about 3000 N/cm. The final calendered paper has a basis weight of 83.4 g/m$^2$, a thickness of 0.094 mm, a density of 0.89 g/cm$^3$, a tensile strength of 26.0 N/cm, and an elongation of 3.22%. This paper is printed without prior coating to provide a printed label or tag.

Example 2

Example 1 is repeated to make first formed and then calendered paper, however the 50/50 slurry blend of fibrids and floc contains 1-7 grams (dry weight) of fibrids and 1.7 grams of a floc mixture and 90 weight percent of the floc is poly (paraphenylene terephthalamide) floc and 10 weight percent is polyethylene terephthalate floc. The poly(paraphenylene terephthalamide) floc had a linear density 0.17 tex (1.5 denier) and length of 0.64 cm. The PET has the same cut length. The final calendered paper has a basis weight of 71.9 g/m$^2$, a thickness of 0.079 mm, a density of 0.91 g/cm$^3$, a tensile strength of 23.3 N/an, and an elongation of 1.90%. This paper is printed without prior coating to provide a printed label or tag.

Example 3

The process of Example 1 is repeated to make first formed and then calendered paper with the addition of 2 grams of the Basacryl Red GL dye, available from BASF Wyandotte Corp., Charlotte, N.C., is added to the 1600 grams of water slurry. The fibrids accept the red dye and a colored paper is made.

Example 4

Example 1 is repeated to make first formed and then calendered paper except that 10 weight percent of the poly (metaphenylene isophthalamide) MPD-1 floc is replaced with floc made from a copolymer derived from 4,4'diaminiodiphenyl sulfone and 3,3'diaminodiphenyl sulfone amine monomers (~70:30 ratio) PSA. The PSA floc has the same cut length as the MPD-I floc. The final floc mixture has a composition of 80% MPD-I floc, 10% PET floc, and 10% PSA floc. The final calendered paper is printed without prior coating to provide a printed label or tag.

Example 5

Example 1 is repeated to make first formed and then calendered paper except that in the aqueous dispersion 20 weight percent of the PSA fibrids are replaced with MPD-I fibrids. The final calendered paper is printed without prior coating to provide a printed label or tag.

What is claimed is:

1. A printable thermally stable uncoated paper, comprising:

a) non-granular, fibrous or film-like polymer fibrids in the form of very finely-divided filmy or irregular fibrous shape particles comprising a polymer or copolymer derived from an amine monomer selected from the group consisting of 4,4'diaminodiphenyl sulfone, 3,3'diaminodiphenyl sulfone, and mixtures thereof, the fibrids having an average maximum dimension of 0.1 to 1 mm, a ratio of maximum to minimum dimension of 5:1 to 10:1, and a thickness of no more than 2 microns;

b) at least one high performance floc selected from the group of para-aramid, meta-aramid, carbon, glass, liquid crystalline polyester, polyphenylene sulfide, polyether-ketone-ketone, polyether-ether-ketone, polyoxadiazole, polybenzazole, and mixtures thereof, the floc having a length of from 2.0 to 25 mm; and c) at least one floc selected from the group of polyester, aliphatic polyamide, viscose and mixtures thereof wherein the weight ratio of fibrids to floc in the paper composition is from 95:5 to 10:90; and wherein the polymer fibrids are present in the paper in an amount of at least 20 weight percent and provide sites for accepting a printing ink on a surface of the paper.

2. The paper of claim 1, further comprising:

d) at least one floc containing a polymer or copolymer derived from a monomer selected from the group consisting of 4,4'diaminodiphenyl sulfone, 3,3'diaminodiphenyl sulfone, and mixtures thereof.

3. The paper of claim 1 wherein the meta-aramid fiber is poly (metaphenylene isophthalamide) fiber.

4. The paper of claim 1, further comprising a second non-granular, fibrous or film-like polymer binder.

5. The paper of claim 4 wherein the polymer binder is selected from the group of meta-aramid fibrids, para-aramid fibrids, and mixtures thereof.

6. The paper of claim 5 wherein the meta-aramid is poly (metaphenylene isophthalamide).

7. The paper of claim 1 wherein the polyester is polyethylene terephthalate or polyethylene naphthalate.

8. The paper of claim 1 wherein the aliphatic polyamide is selected from the group of nylon 6, nylon 66, nylon 610, nylon 11 and mixtures thereof.

9. A heat resistant tag or label, or security paper comprising the paper of claim 1.

10. A wire or conductor wrapped with the paper of claim 1.

11. A laminate structure comprising the paper of claim 1.

12. A honeycomb structure comprising the paper of claim 1.

13. A motor, transformer, or power equipment having an electrical insulating wrapping for wires and/or conductors, the electrical insulating wrapping comprising a printable thermally stable uncoated paper comprising:

a) non-granular, fibrous or film-like polymer fibrids in the form of very finely-divided filmy or irregular fibrous shape particles comprising a polymer or copolymer derived from an amine monomer selected from the group consisting of 4,4'diaminodiphenyl sulfone, 3,3'diaminodiphenyl sulfone, and mixtures thereof, the fibrids having an average maximum dimension of 0.1 to 1 mm, a ratio of maximum to minimum dimension of 5:1 to 10:1, and a thickness of no more than 2 microns:

b) at least one high performance floc selected from the group of para-aramid, meta-aramid, carbon, glass, liquid crystalline polyester, polyphenylene sulfide, polyether-ketone-ketone, polyether-ether-ketone, polyoxadiazole, polybenzazole, and mixtures thereof, the floc having a length of from 2.0 to 25 mm; and c) at least one floc selected from the group of polyester, aliphatic polyamide, viscose and mixtures thereof;

wherein the weight ratio of fibrids to floc in the paper composition is from 95:5 to 10:90; and wherein the polymer fibrids are present in the paper in an amount of at least 20 weight percent and provide sites for accepting a printing ink on a surface of the paper.

* * * * *